US009156655B2

(12) United States Patent
Cao et al.

(10) Patent No.: US 9,156,655 B2
(45) Date of Patent: Oct. 13, 2015

(54) MINING ELEVATOR TRACTION CABLE CONNECTING APPARATUS AND MEASURING METHOD THEREFOR

(75) Inventors: Guohua Cao, Jiangsu (CN); Zhencai Zhu, Jiangsu (CN); Jiancong Qin, Jiangsu (CN); Hongqiao Kang, Jiangsu (CN); Guoan Chen, Jiangsu (CN); Chongqiu Wang, Jiangsu (CN); Renyuan Wu, Jiangsu (CN); Yongguang Cao, Jiangsu (CN); Junhui Wu, Jiangsu (CN); Yilei Li, Jiangsu (CN)

(73) Assignees: China University of Mining and Technology, Jiangsu (CN); Dongnan Elevator Co., Ltd., Jiangsu (CN)

( * ) Notice: Subject to any disclaimer, the term of this patent is extended or adjusted under 35 U.S.C. 154(b) by 540 days.

(21) Appl. No.: 13/697,763

(22) PCT Filed: Aug. 25, 2011

(86) PCT No.: PCT/CN2011/078884

§ 371 (c)(1), (2), (4) Date: Nov. 13, 2012

(87) PCT Pub. No.: WO2012/071913

PCT Pub. Date: Jun. 7, 2012

(65) Prior Publication Data

US 2013/0056313 A1 Mar. 7, 2013

(30) Foreign Application Priority Data

Dec. 3, 2010 (CN) ..... 2010 1 0571286

(51) Int. Cl.
*B66B 7/10* (2006.01)
*B66B 19/06* (2006.01)

(52) U.S. Cl.
CPC .. *B66B 7/10* (2013.01); *B66B 19/06* (2013.01)

(58) Field of Classification Search
CPC ..... B66B 7/10; B66B 19/02; B66B 19/06
USPC ..... 187/264, 265, 266, 345, 346, 347, 391, 187/393, 411, 412; 73/828; 254/228, 264
See application file for complete search history.

(56) References Cited

U.S. PATENT DOCUMENTS 1,516,727 A * 11/1924 Hawkins ..... 187/412
2,385,488 A * 9/1945 Beatty ..... 187/412

(Continued)

FOREIGN PATENT DOCUMENTS

CN 2510459 Y 9/2002
CN 201236089 Y 5/2009

(Continued)

*Primary Examiner* — Anthony Salata
(74) *Attorney, Agent, or Firm* — Christensen Fonder P.A.

(57) ABSTRACT

A mining elevator traction cable connecting apparatus and a measuring method therefor, for use in a mining elevator serving a deep-mine. The apparatus includes an industrial personal computer (IPC), a signal collector connected to the IPC, multiple symmetrically arranged cable rings for use in connecting to one end of a traction cable, and a traction cable tension adjusting apparatus connected to the multiple of cable rings. Arranged within the traction cable tension adjusting apparatus are a plurality of hydraulic cylinders, and a plurality of draw wire displacement sensors for use in monitoring the relative displacement between each hydraulic cylinder plunger and a corresponding hydraulic cylinder body. The draw wire displacement sensors and an oil pressure sensor connected to a hydraulic pipeline are connected to the IPC via the signal collector, forming a traction cable tension and degree of adjustment measuring system.

4 Claims, 3 Drawing Sheets

(56) References Cited

U.S. PATENT DOCUMENTS

| | | | | |
|---|---|---|---|---|
| 4,537,286 | A * | 8/1985 | Morris et al. | 187/412 |
| 5,641,041 | A * | 6/1997 | Masuda et al. | 187/347 |
| 6,065,569 | A * | 5/2000 | Fuller | 187/345 |
| 6,223,862 | B1 * | 5/2001 | Barnes | 187/412 |
| 6,283,451 | B1 * | 9/2001 | Stankus et al. | 254/228 |
| 6,431,321 | B2 * | 8/2002 | Ach | 187/264 |
| 2006/0175152 | A1 * | 8/2006 | Fargo et al. | 187/412 |
| 2013/0233654 | A1 * | 9/2013 | Cao et al. | 187/407 |
| 2014/0110194 | A1 * | 4/2014 | Zhu et al. | 187/254 |

FOREIGN PATENT DOCUMENTS

| | | | |
|---|---|---|---|
| CN | 201240727 | Y | 5/2009 |
| CN | 101759080 | A | 6/2010 |
| CN | 102020161 | A | 4/2011 |
| CN | 201873413 | U | 6/2011 |
| FI | 96675 | B | 4/1996 |
| JP | 5-39181 | A | 2/1993 |

* cited by examiner

MINING ELEVATOR TRACTION CABLE CONNECTING APPARATUS AND MEASURING METHOD THEREFOR

PRIORITY CLAIM

The present application is a National Phase entry of PCT Application No. PCT/CN2011/078884, filed Aug. 25, 2011, which claims priority from Chinese Application 201010571286.0, filed Dec. 3, 2010, the disclosures of which are hereby incorporated by reference herein in their entirety.

FIELD OF THE INVENTION

The present invention relates to a mining elevator hoisting rope connection device and a detection method thereof, in particular for applying to mining elevators in mines of great depth.

BACKGROUND OF THE INVENTION

As buildings become increasingly higher, the lifting heights of elevators increase accordingly; especially, elevators are often used to transport workers in mines of great depth; in those environments, the phenomenon of tension unbalance among the hoisting ropes becomes apparent; consequently, fraction wheel rope-groove and hoisting ropes wear down in an unbalanced manner, and thereby cause severe sway of the elevator car in the lifting process. Existing hoisting rope tension regulating devices for mining elevators mainly employ compression springs or rubber pads for a connection cushion at the terminals of hoisting ropes. Though such an arrangement achieves a cushion and shock absorption effect, the hoisting rope tension may be unbalanced after the hoisting ropes are used for some time due to manufacturing error and material differences amongst the hoisting ropes; consequently, the traction wheel rope-grooves will wear down in an uneven manner, the elevator car cannot operate steadily, the hoisting ropes will wear down severely, and the service life will be shortened.

SUMMARY

To overcome the drawbacks in the prior art, the claimed invention provides a mining elevator hoisting rope connection device which possesses simple structure, balanced hoisting rope tension, steady operation of an elevator car, long service life, and reliable performance, and further provides a detection method for the mining elevator hoisting rope connection device.

An embodiment of the mining elevator hoisting rope connection device of the claimed invention comprises an industrial personal computer (IPC), a signal acquiring device connected to the IPC, a plurality of rope rings arranged in symmetry and designed to connect the terminals of hoisting ropes, and a hoisting rope tension regulating device connected with the plurality of rope rings and fixed to a platform in the machine room or the elevator car; wherein, the hoisting rope tension regulating device comprises a plurality of hydraulic cylinders in the same quantity as the rope rings, a plunger pulling plate and a cylinder body fixing frame designed to fix the plurality of hydraulic cylinders, fixing connectors designed to connect the hydraulic pipeline with the oil circuits in the hydraulic cylinder bodies are arranged on the lower part of the cylinder body fixing frame, plunger connectors designed to connect the plungers in the plurality of hydraulic cylinders are arranged on the upper part of the cylinder body fixing frame, a reversing connector designed to be plug-in connected to the cylinder body fixing frame via a pin roll is arranged on the top end of the cylinder body fixing frame, and connecting bolts designed to fix the cylinder body fixing frame and plunger pulling plate are arranged on the bottom end of the cylinder body fixing frame; a plurality of guyed displacement sensors that are in the same quantity as the rope rings and designed to monitor the relative displacement between plunger and cylinder body of each hydraulic cylinder in real time are arranged in the hoisting rope tension regulating device, an oil pressure sensor is arranged on the hydraulic pipeline, and the oil pressure sensor and guyed displacement sensor are connected to the IPC via the signal acquiring device, so as to form a hoisting rope tension and regulating variable detection system.

The cylinder body fixing frame comprises hollow square frame clamp plates arranged at an interval, web plates arranged around the hollow square frame clamp plates, and upper seal plates arranged on the top of the web plates; cylinder body filler blocks designed to fix the cylinder body are arranged on both sides of the hydraulic cylinder body.

An embodiment of the detection method for the hoisting rope connection device of the present invention is as follows:

(1) The hydraulic oil pressure of each cylinder body in the cylinder body fixing frame is monitored in real time by means of the oil pressure sensor connected with the hydraulic pipeline, the acquired signals are transmitted by the signal acquisition device to the IPC for data processing and analysis, and the preset range of oil pressure of the hydraulic cylinder bodies is determined according to the pressure difference between initial pressure under zero load and pressure under heavy load as well as the load fluctuation range; if the pressure of the hydraulic pipeline is within the preset range, it indicates each hydraulic cylinder is operating normally; if the pressure of the hydraulic pipeline is beyond the preset range, it indicates there is hydraulic oil leakage in the hydraulic cylinders, and in that case, the IPC will analyze and treat the problem appropriately, and provide alarm indication;

(2) The relative displacement between plunger and cylinder body on each hydraulic cylinder in the cylinder body fixing frame is monitored in real time by the guyed displacement sensors, the acquired signals are transmitted by the signal acquisition device to the IPC for data processing and analysis, and the preset range of monitored displacement is determined according to the plunger strokes in the hydraulic cylinders and the displacement fluctuation range; if the displacement is within the preset range, it indicates the plungers can regulate the hoisting rope tension normally; if the displacement is beyond the preset range, it indicates the hoisting rope tension regulating device cannot regulate the hoisting rope tension, and in that case, the IPC will analyze and treat the problem appropriately, and provide alarm indication.

With the above technical solution, the hoisting rope connection device can regulate the tension of hoisting ropes in a deep well, monitor the tension and regulated amount of hoisting ropes in real time, and provide alarm indication in case the hoisting rope displacement is beyond the maximum range of regulation. The hoisting rope connection device of the claimed invention has the following advantages:

(1) The towline hoisting rope regulating device is easy to fabricate and has reliable performance, can regulate and balance the hoisting rope tension automatically, and can improve the reliability of pipeline connection in hydraulic cylinder bodies and dynamic regulation of plungers and increase the service life of hoisting rope.

(2) The hoisting rope connection device can monitor the tension and regulated amount of hoisting ropes in real time by detecting the oil pressure of the hoisting rope tension regulating device and the displacement between cylinder body and plunger;

(3) The hoisting rope connection device has simple structure, balanced hoisting rope tension, steady operation of the elevator car, long service life, easy processing, reliable performance, and convenient installation and maintenance, can monitor hoisting rope tension and regulate displacement automatically, and can provide alarm indication in case the displacement is beyond the maximum range of regulation.

Figure 1:
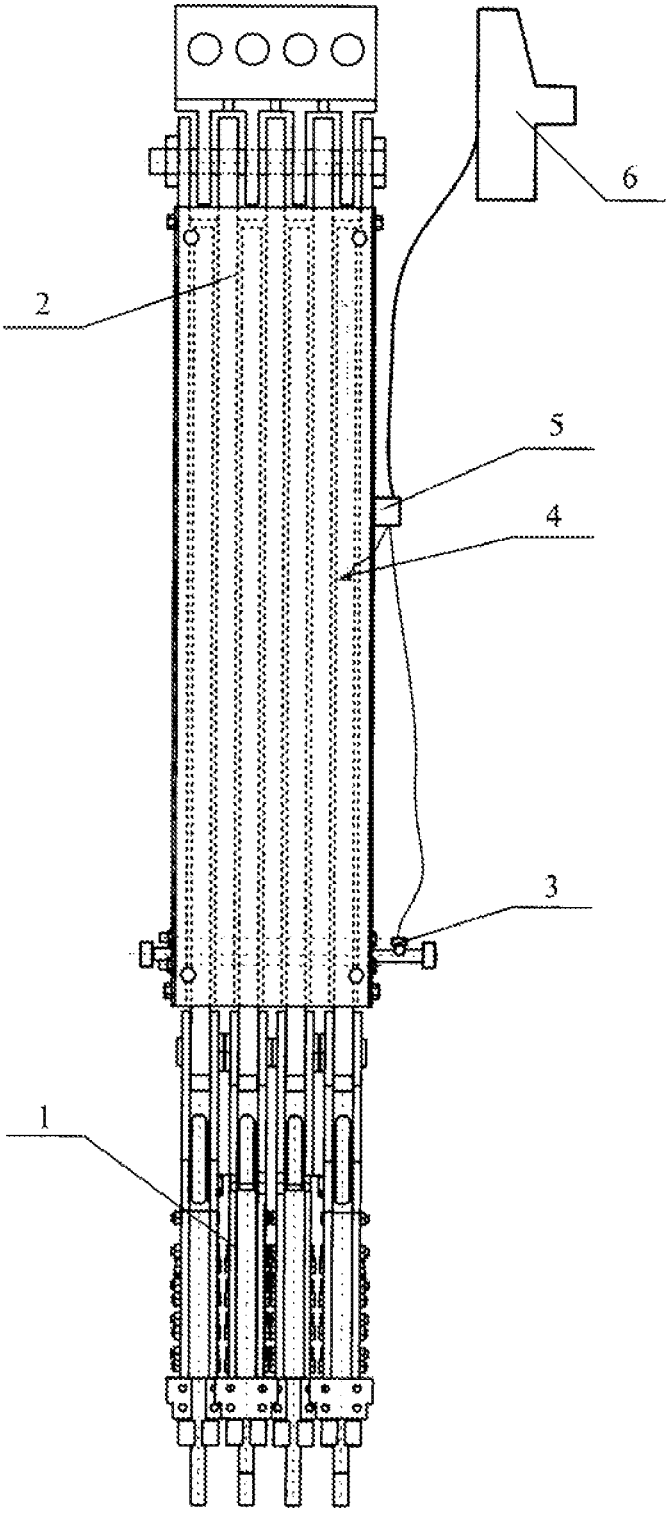
FIG. 1 is a front view of the mining elevator connection device according to an embodiment of the claimed invention.

In the figures the following reference numerals are used: rope ring-1, hoisting rope tension regulating device-2, oil pressure sensor-3, guyed displacement sensor-4, signal acquiring device-5, IPC-6, hoisting rope-7; reversing connector-2-1, pin roll-2-2, upper seal plate-2-3, cylinder body fixing frame-2-4, web plate-2-5, cylinder body fixing connector-2-6, cylinder body fixing bolt-2-7, cylinder body fixing frame connecting bolt-2-8, plunger pull plate-2-9, plunger connector-2-10, cylinder body filler block-2-11, plunger-2-12, composite bushing-2-13, seal ring-2-14, hydraulic cylinder body-2-15, hydraulic port-2-16, hydraulic pipeline-2-17.

DETAILED DESCRIPTION

Figure 2:
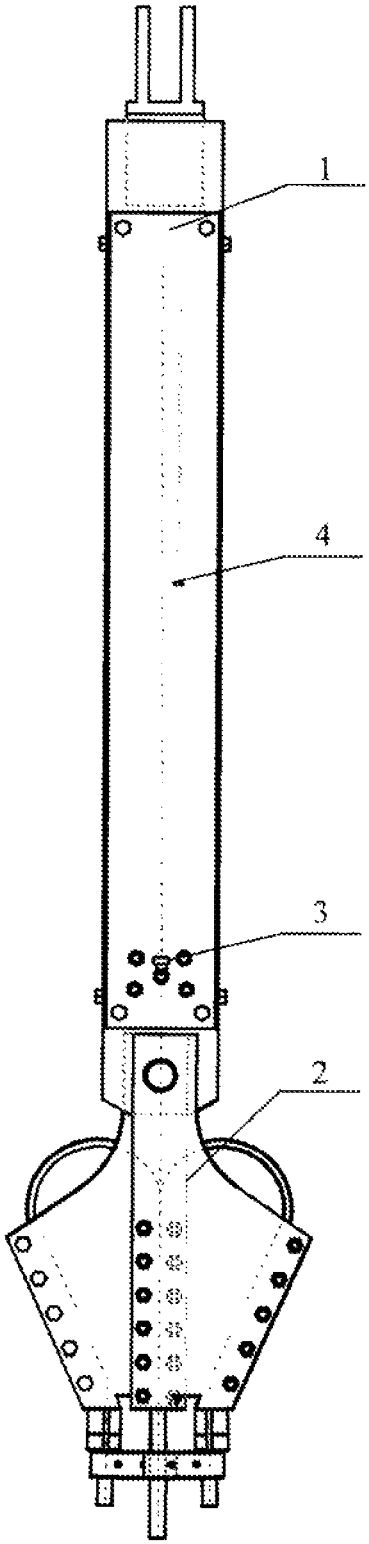
FIG. 2 is a side view of the mining elevator connection device of FIG. 1.

Combined with the drawings, one of the embodiments of the present invention is explained in more detail in the following description:

As shown in FIGS. 1 and 2, the mining elevator connection device of the claimed invention comprises an IPC 6, a signal acquiring device 5 connected to the IPC 6, a plurality of rope rings 1 arranged in symmetry and designed to connect with the terminals of the hoisting ropes, and a hoisting rope tension regulating device 2 which is fixed to a machine room platform or an elevator car connected to the plurality of rope rings 1, wherein, an oil pressure sensor 3 is arranged in the hoisting rope tension regulating device 2, a plurality of guyed displacement sensors 4 in the same quantity as the rope rings 1 are arranged in the hoisting rope tension regulating device 2, and the oil pressure sensor 3 and guyed displacement sensors 4 are connected to the IPC 6 via the signal acquiring device 5 so as to form a hoisting rope tension and regulated amount detection system.

Figure 3:
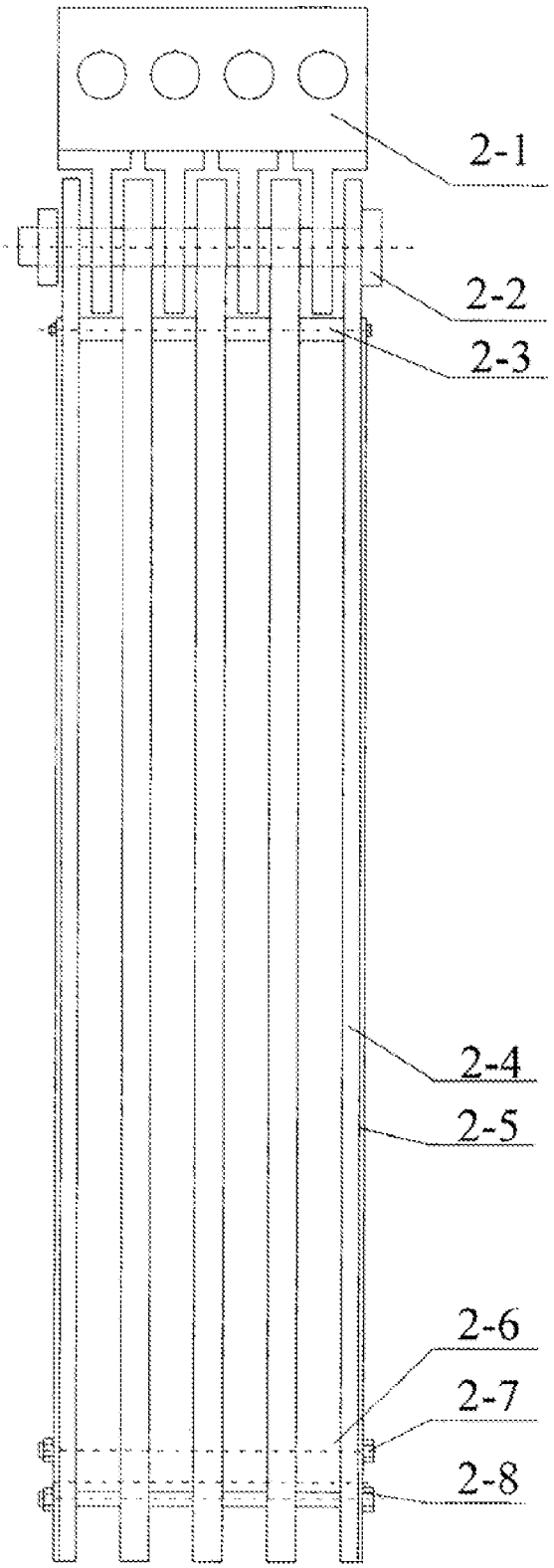
FIG. 3 is a front view of the cylinder body fixing frame according to an embodiment of of the claimed invention.
Figure 4:
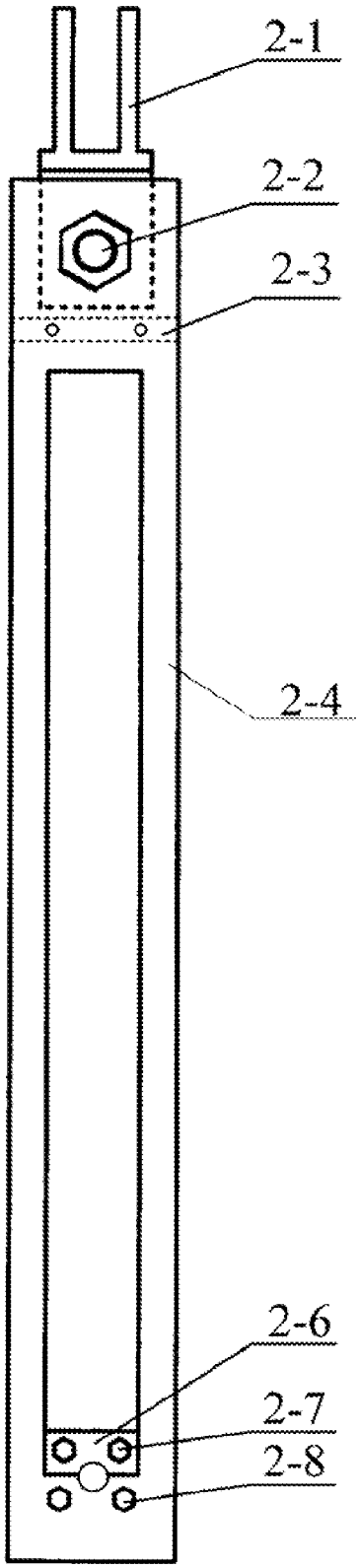
FIG. 4 is a side view of the cylinder body fixing frame of FIG. 3.
Figure 5:
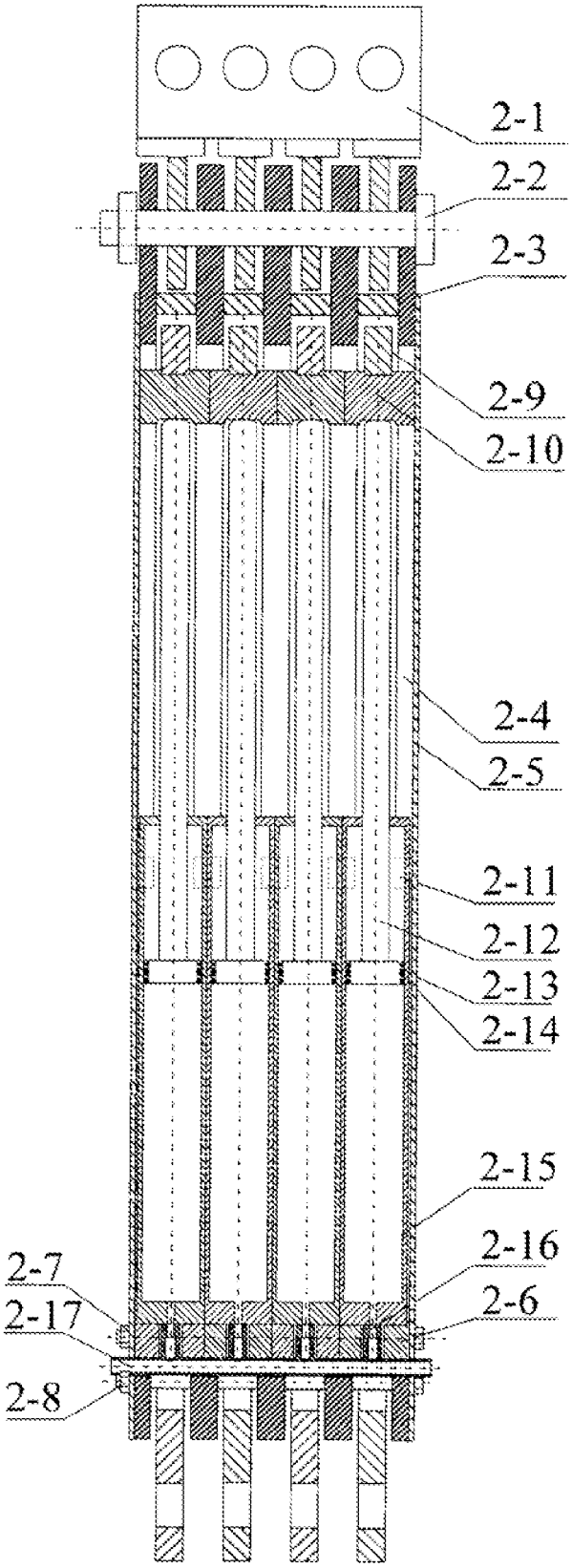
FIG. 5 is a partial sectional view of the hoisting rope tension regulating device according to an embodiment of the claimed invention.

As shown in FIGS. 3, 4, and 5, the hoisting rope tension regulating device 2 comprises a cylinder body fixing frame 2-4 in which hydraulic cylinders are installed, a plurality of cylinder body fixing connectors 2-6 designed to fix a plurality of hydraulic cylinder bodies 2-15 are mounted on one end of the cylinder body fixing frame 2-4 by cylinder body fixing bolts 2-7, a plunger connector 2-10 designed to connect with a plurality of hydraulic cylinder plungers 2-12 is mounted on the other end of the cylinder body fixing frame 2-4, and a plunger pull plate 2-9 connected to the rope rings 1 is arranged on the plunger connector 2-10; the cylinder body fixing frame 2-4 comprises hollow square frame clamp plates arranged at an interval, web plates 2-5 arranged around the hollow square frame clamp plates, and upper seal plates 2-3 arranged on the top of the web plates 2-5; the space is sealed by four web plates 2-5 and top seal plates 2-3, so as to prevent degradation of leak tightness of the cylinder body resulted from intrusion of foreign matters (dust, water, etc.) to the plungers. The cylinder body fixing frame 2-4 is connected and fixed by connecting bolts -2-8; each clamp plate on the upper end of the cylinder body fixing frame 2-4 has connecting holes, and are connected to a reversing connector 2-1 via a pin roll 2-2, so as to fix the cylinder body fixing frame 2-4 to a machine room platform or an elevator car. The hydraulic cylinder bodies 2-15 have cylinder body filler blocks 2-11 for stabilization purposes on the upper part, and have hydraulic ports 2-16 on the bottom; the hydraulic ports 2-16 of the cylinder body are connected to the exterior with each other through hydraulic pipeline 2-17. One end of the plunger 2-12 in the cylinder body comprises a piston, an assembled seal ring 2-14, and a composite bushing 2-13; the other end of the plunger 2-12 is propped on one side of the plunger pull plate 2-9 via the plunger connector 2-10, and the other side of the plunger pull plate 2-9 is connected to the rope rings 1.

A detection method for hoisting rope connection device of the claimed invention is as follows:

(1) Hydraulic oil, in an appropriate quantity based on the volume of the cylinder bodies, is filled into each hydraulic cylinder body 2-15 through interconnected hydraulic pipeline 2-17 and hydraulic ports 2-16, then, the hydraulic pipeline 2-17 is sealed and the elevator car is lifted up under zero load; the rope rings 1 connected with the hoisting ropes 7 apply the forces to the plunger pull plate 2-9, and the plunger pull plate 2-9 presses the plungers 2-12 via the plunger connector 2-10; the interconnected hydraulic oil pressure of the cylinder bodies is monitored by means of the oil pressure sensor 3, and the acquired signals are transmitted to the IPC 6 by the signal acquiring device 5 for data processing and analysis, wherein the pressure in this state is the initial pressure under zero load; then, the elevator car is lifted up under heavy load, the pressure in the hydraulic cylinder bodies 2-15 under heavy load is determined, and the pressure in this state is recorded; next, the preset range of pressure of the hydraulic cylinder bodies is determined according to the pressure difference between initial pressure under zero load and pressure under heavy load and the load fluctuation range; during use phase, if the pressure of the hydraulic pipeline is within the preset range, it indicates each hydraulic cylinder is operating normally, i.e., the hoisting rope tension regulating device 2 is operating normally; if the pressure of the hydraulic pipeline is beyond the preset range, it indicates there is hydraulic oil leakage in the hydraulic cylinders, and in that case, the IPC 6 is used to analyze and treat the problem appropriately, and provide alarm indication for manual maintenance;

(2) The relative displacement between plunger 2-12 and hydraulic cylinder body 2-15 of each hydraulic cylinder is monitored in real time by means of the guyed displacement sensors 4, and the data obtained by the signal acquiring device 5 is transmitted to the IPC 6 for processing and analysis; the preset range of displacement is determined according to the strokes of plungers 2-12 in the hydraulic cylinders and the displacement fluctuation range; if the displacement monitored by the guyed displacement sensors 4 is within the preset range, it indicates the hoisting rope tension regulating device 2 can regulate the tension of hoisting ropes 7; if the monitored displacement is beyond the preset range, it indicates the hoisting rope tension regulating device 2 can not regulate the tension of hoisting ropes 7, and in that case, the IPC 6 is used to analyze and treat the problem appropriately, and provide alarm indication for manual maintenance.

The invention claimed is:

1. A mining elevator hoisting rope connection device, comprising an industrial personal computer (IPC), a signal acquiring device connected to the IPC, and a plurality of rope rings arranged in symmetry and designed to connect with the terminals of hoisting ropes, wherein, a hoisting rope tension regulating device which is fixed to a machine room platform or an elevator car is connected to the plurality of rope rings; the hoisting rope tension regulating device comprises a cylinder body fixing frame, a plurality of hydraulic cylinders in the same quantity as the ring ropes in the cylinder body fixing frame, and a plunger pull plate designed to fix the plurality of hydraulic cylinders, fixing connectors designed to connect the hydraulic pipeline and the hydraulic cylinder bodies are arranged on the lower part of the cylinder body fixing frame, a plunger connector designed to connect the hydraulic cylinder plungers is arranged on the upper part of the cylinder body fixing frame, a reversing connector designed to be plug-in connected to the cylinder body fixing frame via a pin roll is arranged on the top end of the cylinder body fixing frame, and cylinder body fixing frame connecting bolts designed to fix the cylinder body fixing frame and plunger pull plate are arranged on the bottom end of the cylinder body fixing frame; a plurality of guyed displacement sensors that are in the same quantity as the rope rings and designed to monitor the relative displacement between plunger and hydraulic cylinder body of each hydraulic cylinder in real time are arranged in the hoisting rope tension regulating device, an oil pressure sensor is arranged on the hydraulic pipeline, and the oil pressure sensor and the guyed displacement sensors are connected to the IPC via the signal acquiring device so as to form a hoisting rope tension and regulated amount detection system.

2. The mining elevator hoisting rope connection device according to claim 1, wherein, the cylinder body fixing frame comprises hollow square frame clamp plates arranged at an interval, web plates arranged around the hollow square frame clamp plates, and upper seal plates arranged on the top of the web plates.

3. The mining elevator hoisting rope connection device according to claim 1, wherein, cylinder body filler blocks designed to fix the cylinder body are arranged on both sides of the hydraulic cylinder body.

4. A detection method for the mining elevator hoisting rope connection device as described in claim 1, wherein:

(1) Monitoring the hydraulic oil pressure of each cylinder body in the cylinder body fixing frame in real time by means of the oil pressure sensor connected to the hydraulic pipeline, transmitting the signals acquired by the signal acquiring device to the IPC for data processing and analysis, and determining the preset range of pressure of the hydraulic cylinder bodies according to the difference between initial pressure under zero load and pressure under heavy load and the load fluctuation range; judging that each hydraulic cylinder is operating normally, if the pressure in the hydraulic pipeline is within the preset range, or judging that there is hydraulic oil leakage in the hydraulic cylinders, and utilizing the IPC to analyze and treat the problem and provide alarm indication if the pressure in the hydraulic pipeline is beyond the preset range;

(2) Monitoring the relative displacement between plunger and hydraulic cylinder body of each hydraulic cylinder in real time by means of the guyed displacement sensors, transmitting the acquired signals via the signal acquiring device to the IPC for data processing and analysis, and determining the preset range of monitored displacement according to the strokes of plungers in the hydraulic cylinders and the displacement fluctuation range; judging that the hoisting rope tension regulating device can regulate the hoisting rope tension normally if the monitored displacement is within the preset range, or judging that the hoisting rope tension regulating device cannot regulate the hoisting rope tension and utilizing the IPC to analyze and treat the problem and provide alarm indication if the monitored displacement is beyond the preset range.

* * * * *